US011957967B2

(12) United States Patent
Sigesmund et al.

(10) Patent No.: US 11,957,967 B2
(45) Date of Patent: Apr. 16, 2024

(54) FINGER PRESSURE SENSING DEVICE FOR A SPORTS IMPLEMENT

(71) Applicants: Mitchell Blake Sigesmund, Del Mar, CA (US); Connor A Lunn, Carlsbad, CA (US)

(72) Inventors: Mitchell Blake Sigesmund, Del Mar, CA (US); Connor A Lunn, Carlsbad, CA (US)

( * ) Notice: Subject to any disclaimer, the term of this patent is extended or adjusted under 35 U.S.C. 154(b) by 114 days.

(21) Appl. No.: 17/027,360

(22) Filed: Sep. 21, 2020

(65) Prior Publication Data

US 2021/0086050 A1 Mar. 25, 2021

Related U.S. Application Data

(60) Provisional application No. 62/903,209, filed on Sep. 20, 2019.

(51) Int. Cl.
*A63B 69/00* (2006.01)
*A63B 43/00* (2006.01)
*A63B 45/00* (2006.01)

(52) U.S. Cl.
CPC ..... *A63B 69/0002* (2013.01); *A63B 43/002* (2013.01); *A63B 45/00* (2013.01); *A63B 43/00* (2013.01); *A63B 2069/0006* (2013.01); *A63B 2220/30* (2013.01); *A63B 2220/40* (2013.01); *A63B 2220/56* (2013.01); *A63B 2225/50* (2013.01)

(58) Field of Classification Search
CPC ... A63B 69/0002; A63B 43/002; A63B 43/00; A63B 45/00; A63B 2069/0006; A63B 2220/30; A63B 2220/40; A63B 2220/50; A63B 2220/56
USPC ..... 473/422; 600/587
See application file for complete search history.

(56) References Cited

U.S. PATENT DOCUMENTS 8,638,236 B2 * 1/2014 Chen ..... H04Q 9/00 342/357.57
10,603,566 B2 * 3/2020 Wu ..... A63B 69/002
10,806,967 B2 * 10/2020 Niegowski ..... A63B 24/0006
(Continued)

FOREIGN PATENT DOCUMENTS

CN 105311796 A * 2/2016
FR 2936140 A1 * 3/2010 ..... A61B 5/225

*Primary Examiner* — Mitra Aryanpour
(74) *Attorney, Agent, or Firm* — Scott C Harris, Esq

(57) ABSTRACT

A sports performance sensor for an implement used in sports, such as a bat or baseball. The implement, e.g. the bat or baseball, is formed with an area inside that can include circuitry. The circuitry can measure rotation acceleration, and speed. The outer surface of this device has pressure sensing fabric, which senses location and pressure on the outer surface. This can form a pressure map of where the user's fingers are touching the outer surface. The information from the user's performance in using the device are transmitted to an external computer such as a phone which creates a pressure sensing map. This pressure sensing map can then be compared to data from either the same user at a different time or from other users. This can be specific to different actions, for example it can be specific to the user throwing a specific kind of pitch, or the user carrying out a specific operation such as swinging a bat to hit a specific kind of pitch.

15 Claims, 5 Drawing Sheets

(56) References Cited

U.S. PATENT DOCUMENTS

| | | | | |
|---|---|---|---|---|
| 2012/0077163 | A1* | 3/2012 | Sucar Succar | A61H 1/00 434/247 |
| 2012/0277040 | A1* | 11/2012 | Vincent | A43B 3/34 473/570 |
| 2014/0194232 | A1* | 7/2014 | Krysiak | A63B 41/085 473/570 |
| 2014/0200103 | A1* | 7/2014 | Thurman | A63B 43/06 473/570 |
| 2015/0065263 | A1* | 3/2015 | Luttrull | A63B 53/14 473/202 |
| 2015/0314164 | A1* | 11/2015 | Sampathkumaran | G06V 40/23 473/461 |
| 2017/0086519 | A1* | 3/2017 | Vigano' | A63B 71/141 |
| 2018/0071600 | A1* | 3/2018 | Horner | A61B 5/6895 |
| 2019/0060735 | A1* | 2/2019 | Wu | A63B 69/002 |
| 2021/0275074 | A1* | 9/2021 | Freehill | A61B 5/0022 |

* cited by examiner

FINGER PRESSURE SENSING DEVICE FOR A SPORTS IMPLEMENT

This application claims priority from Ser. No. 62/903,209, filed Sep. 20, 2019, the entire contents of which are herewith incorporated by reference.

BACKGROUND OF THE INVENTION

Many sports use sports equipment, such as balls, bats, clubs, rackets and other items. These items are referred to herein generically as "sports implements".

Players typically try to improve their technique using the sports implement. For example, baseball players may attempt to improve their batting stance, or a pitcher may attempt to improve their performance of pitching.

The players often have a general sense of what they can do with each sports implement.

For example, a pitcher may have a general sense of what they can do with each type of pitch and how the ball travels along its path.

SUMMARY

The inventors recognize that the understanding of performance in using the sports implement is often notional, and that there is no measure-based system for quantifying the course of the operation using the sports implement.

Embodiments describe finger pressure detection, and detection of various speeds and vectors, in the course of carrying out determining the operation of player using a sports implement.

An embodiment describes detecting recording interpreting and sharing information regarding finger pressure sensing of the player's fingers on the sports implement.

An embodiment describes modifying the sports implement to add a finger pressure sensor in a way which does not change the weight or balance of the sports implement.

The inventors believe that knowing how to control technique correlates to performance in a systemic an objective manner. An embodiment describes a system where athletes and players can share the results of their finger pressure sensing with other players, forming a community of players who can improve the game.

An embodiment describes a sports implement of the same weight and size of in-game devices with the added features of:

finger pressure—which the inventors recognize is a key missing metric that identifies the most inclusive training data because it comes from the players' motion and grip—and connectivity in real time—to give an immediate set of data to players using the device and provide an ecosystem to grow and learn with other players using the device.

An embodiment adds pressure mapping sensors to the inside skin of a sports implement (baseball, football, etc. . . . ) along with movement detecting devices including gyroscopes, rotameters, and accelerometers to capture the key metrics of player data.

The connectivity focuses on being able to translate the data produced using the sports device to an application via a wireless connection, e.g., Bluetooth, to a computer, e.g., running an app that carries out these functions.

The application creates an ecosystem for players to interact while fostering growth via the application and the metrics given.

BRIEF DESCRIPTION OF THE DRAWINGS

The drawings show aspects of the invention, specifically.

DETAILED DESCRIPTION

It will be appreciated that for clarity of illustration, elements illustrated in the figures have not necessarily been drawn to scale. For example, the dimensions of some of the elements may be exaggerated relative to other elements.

The inventors believe the players of sports typically do not have an easy way to determine scientifically and to quantify how they are gripping the implement of their sports. An embodiment describes a system which determines finger pressure and placement on the implement. This is done by modifying the implement to include finger pressure sensors.

An embodiment also determines speeds and vectors of using the sports implement, and allows sharing information with other interested people. An embodiment describes a system that allows individuals to view how finger pressure effects athletic performance. This includes a system which detects pressure and determines factors including spin rate, speed, spin, acceleration/deceleration, timing of mechanics through release of finger pressure. In an embodiment, the system tracks statistics and other data relating to athletic performance.

In an embodiment, the metrics are communicated with a web-based application system that allows users to share and explain their sensed finger pressure information forming a social forum for individuals.

A first embodiment is described relative to a sports instrument being a ball such as a baseball. However it should be understood that this embodiment can also be used in other sports also and other implements, such as bats, rackets, sticks and any other implement used in any other sport.

Figure 1:
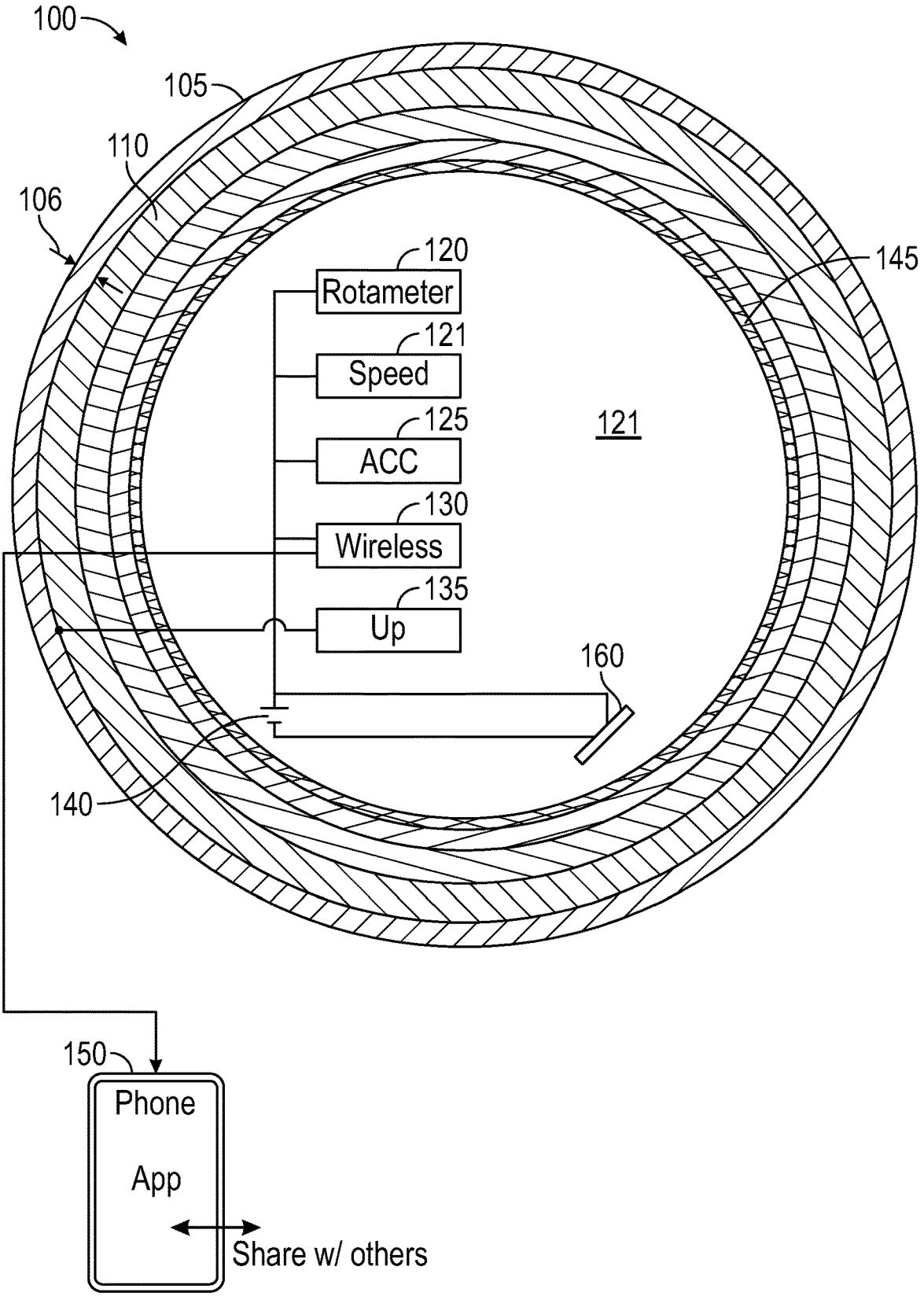
FIG. 1 shows an embodiment, where the sports implement is a ball, and the ball is modified to include various parameter sensing devices.

FIG. 1 illustrates the ball 100 which has been modified according to the present application. In an embodiment, the ball is of substantially the same weight and size as a regulation baseball. By the term substantially the same weight and size, we mean that the ball is preferably within the same statistics for allowable weight and size as a regulation ball. In another embodiment, however, the ball may be as much as 10% or 20% heavier or lighter than a regulation ball, understanding that the 10 or 20% will not make a performance difference for many average players. However, it is preferred that the ball be within the same weight and size as the allowable parameters for a regulation ball.

The ball 100 includes a skin 105 which has been removed and replaced according to the techniques described herein. In one embodiment, the skin 105 is shaven down so that its thickness 106 is reduced compared to the normal thickness of a skin of a regulation ball. A pressure mapping fabric 110 inside the skin 105 is located to surround the inside "nucleus" 121 of the ball. The nucleus of the ball is modified to include electronic circuitry, namely, a rotameter 120, a speed detector 124, and accelerometer 125. Information from these sensors, and from the pressure mapping fabric 110, is detected by a microprocessor 135. Among other things, the microprocessor 135 senses finger pressure and placement. The information obtained is shared with a server/app/other computer, and shared with others over a social network type system. The finger pressure information as detected and interpreted by the processor 135 is communicated via a wireless network device 130 to an external computer. The wireless network device 130 can communicate via for example Bluetooth, Wi-Fi, or any other wireless communication format.

The finger pressure map can be displayed on a smart phone or tablet or PC.

The entire assembly is powered by a battery 140 which can be for example a rechargeable battery. In an embodiment, the battery 140 can be charged via a wireless charging system 160, so that the ball can be laid on top of the charging port to wirelessly charge the device. In one embodiment, for example, there can be a mark drawn on the outside of the ball of the location of the wireless charger, to facilitate the wireless charging.

In one embodiment, the nucleus 121 is located in a way which is radially symmetrical, to maintain the radial symmetry of the ball. The circuitry is also radially symmetrically disposed within the ball, as described herein. A string assembly of wound strings 145 is wound around the ball to offset the weight difference of the replaced ball center which has been replaced by the nucleus 121.

In a similar way, the skin 105 has been thinned to replace the weight of the pressure sensing fabric 110. The FIG. 1 shows only a few rounds of the string 140; however it should be understood that the string can be wound in a way that is also radially symmetric.

In one embodiment, the wireless connective device 130 connects to a smart phone shown as 150, which runs an app that accesses and stores information about the finger pressure sensed by smart device. The app can operate as described herein.

Figure 2:
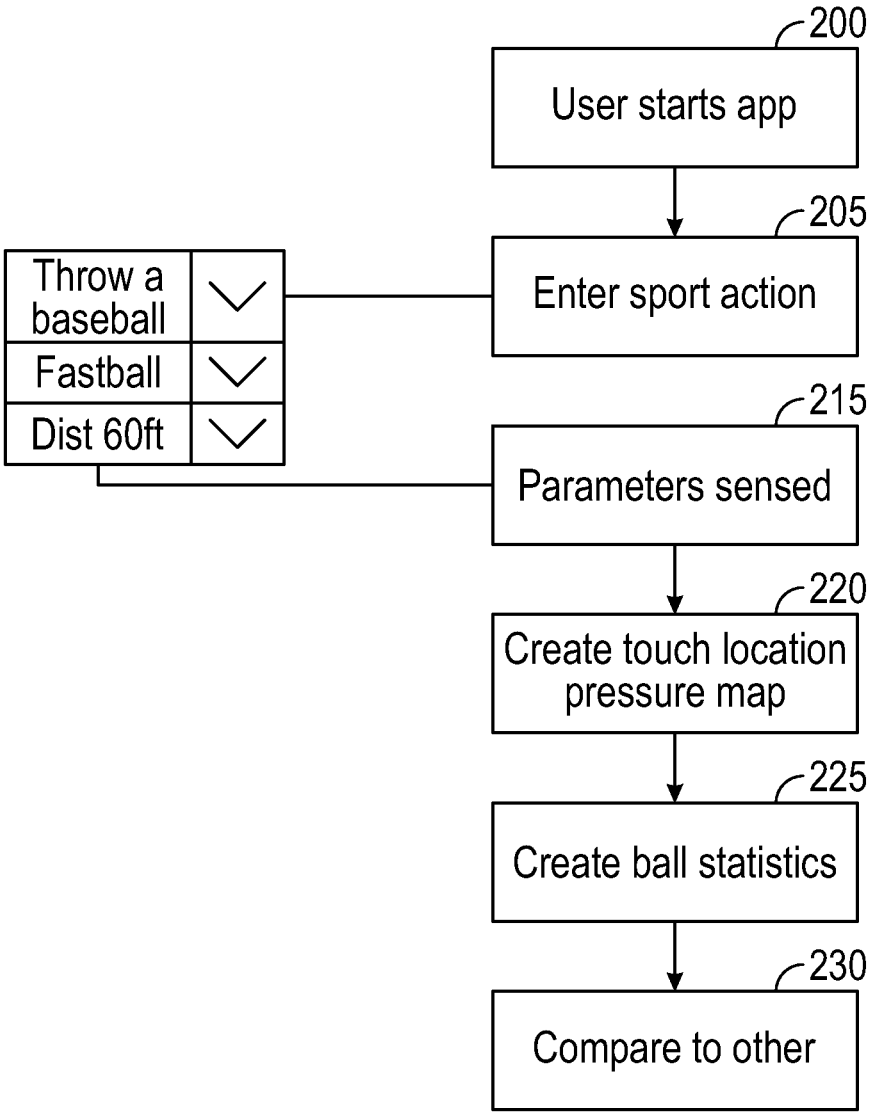
FIG. 2 shows a flowchart of operation.

FIG. 2 illustrates a flowchart of the operation of the app and its communication with the other circuitry described herein. At 200, the user starts the app, and manually enters the kind of sport action that they are doing at 205. The app may also automatically default to the previous sport action which was being done. The detection may drill down to various degrees of specificity. For example, the most general may be throwing a baseball, but this may drill down even further to a fastball or slow ball or curveball, for example, a distance of throwing such as 60 feet, or other actions that can occur during baseball operation. Once the action has been entered, at 215, the parameters of the sports implement operation are sensed. This includes the finger pressure at each of a plurality of different locations on the surface of the ball being sensed.

Again, the above embodiment describes operation using an implement which is a ball. Analogous actions can occur for other sports implements such as finger pressure obtained while swinging a bat, swinging a tennis racket, or taking some other action with a sporting implement that can be gripped by a player.

The processor 135 receives information from all of the different sensors including receiving the locations and pressure on which the user is touching the outside skin of the ball, and creates a touch and location pressure map at 220.

In addition, the computer receives information about the rotation of the ball from the rotatometer 120, and acceleration from the accelerometer 125, and also receives the speed from speed sensor 124. The computer can also receive other information about the movement of the ball. All of this gets translated to information that can be correlated to the information about the sports operation. This allows statistics about the ball throwing to be recorded at 225, including speed, Spin rate, finger pressure, spin axis, vertical movement, and horizontal movement.

The information from each throw, pitch or movement of the implement is shared via the wireless connection, with the smart phone app 150.

In embodiments, the system may determine different kinds of information about grip pressure and compare that with grip pressure and location of others when throwing a similar kind of pitch or throw. The system can also monitor speed, accuracy, hand placement hand placement consistency, and rotation.

One embodiment can use the system to compare each action at a first time with a corresponding action at another time. For example, the system can compare the grip placement movement and other sensor information each time the user throws a "fastball" with other times that the user has thrown a fastball. This can be done for each user, for example, and can also be done for other users, so that each user can see the way including location and pressure that other users grip the fastball. This can also be correlated with how fast they throw it, the speed and movement and velocity of the ball during the throwing, and other information. If one user admires the form of another user, then they can attempt to copy it by modifying their own technique.

Another embodiment can model information about the use of the implement. Different things which can be monitored include grip pressure analysis relative to a model, grip placement analysis relative to a model, speed analysis, correlations between speed and grip pressure, correlations between spin and grip pressure.

In one embodiment, the pressure sensing fabric is molded into a half spherical shape, within which the circuitry of the nucleus 121 will be molded. This uses two semispherical molds 300 as the outside mold, and 310 as the inside mold.

The inner surface 301 of the outer semispherical mold 300 forms the outer surface of the fabric 305, e.g, the pressure sensing fabric. Hence, the inner surface 301 of the outer mold 300 needs to be sized to hold the outer surface of the pressure sensing fabric 305. The fabric itself 305 may be multiple layers of fabric which are pressed between the inner mold and the outer mold. These multiple layers of fabric may include not only pressure sensing fabric, but also a flex PCB board, and other fabrics as necessary. The outer surface 311 of the inner mold 310 is sized to fit within the inner surface of the outer mold 300, allowing for the thickness of the multiple layers of fabric 305.

Figure 3A:
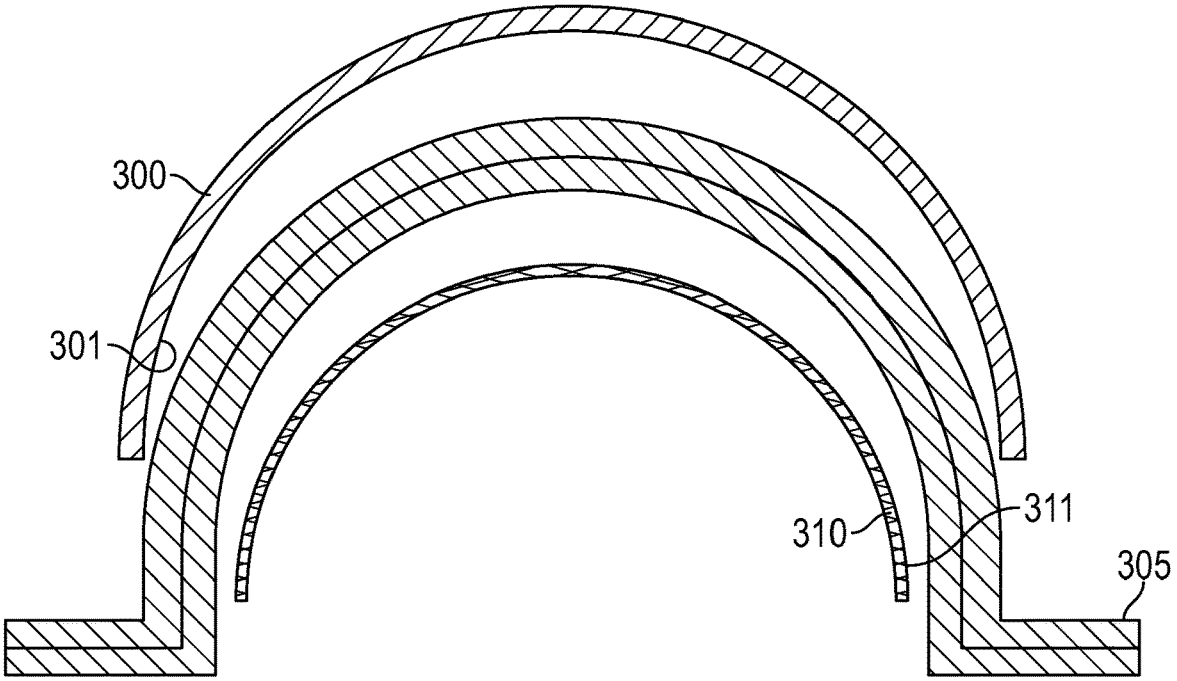
FIG. 3 *a* shows a cross-section of using spherical molds to hold the fabric into a rounded shape.
FIG. 3B shows the ball shaped area which is left after using the spherical molds.
Figure 3B:
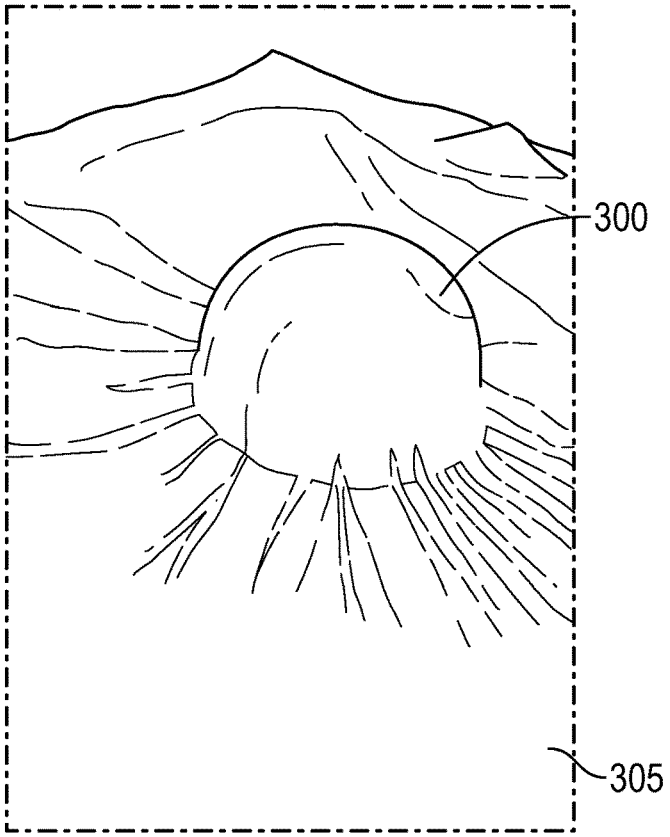

The molds can be formed of silicon, for example 0.2 cm thick or less. In an embodiment, the silicon molds are 3D printed to the size and shape desired, as described above. FIG. 3B shows how when the upper silicon mold 300 is removed, this leaves a ball shaped area 320 of pressure sensing fabric 305 formed around the conjunction of the 2 semicircles.

The circuitry described above is placed on the inside of the ball shaped area 320 and connected as necessary. At this point, adhesive, string and the leather ball covering leather is added around the inside of the ball shaped area 320.

Figure 4A:
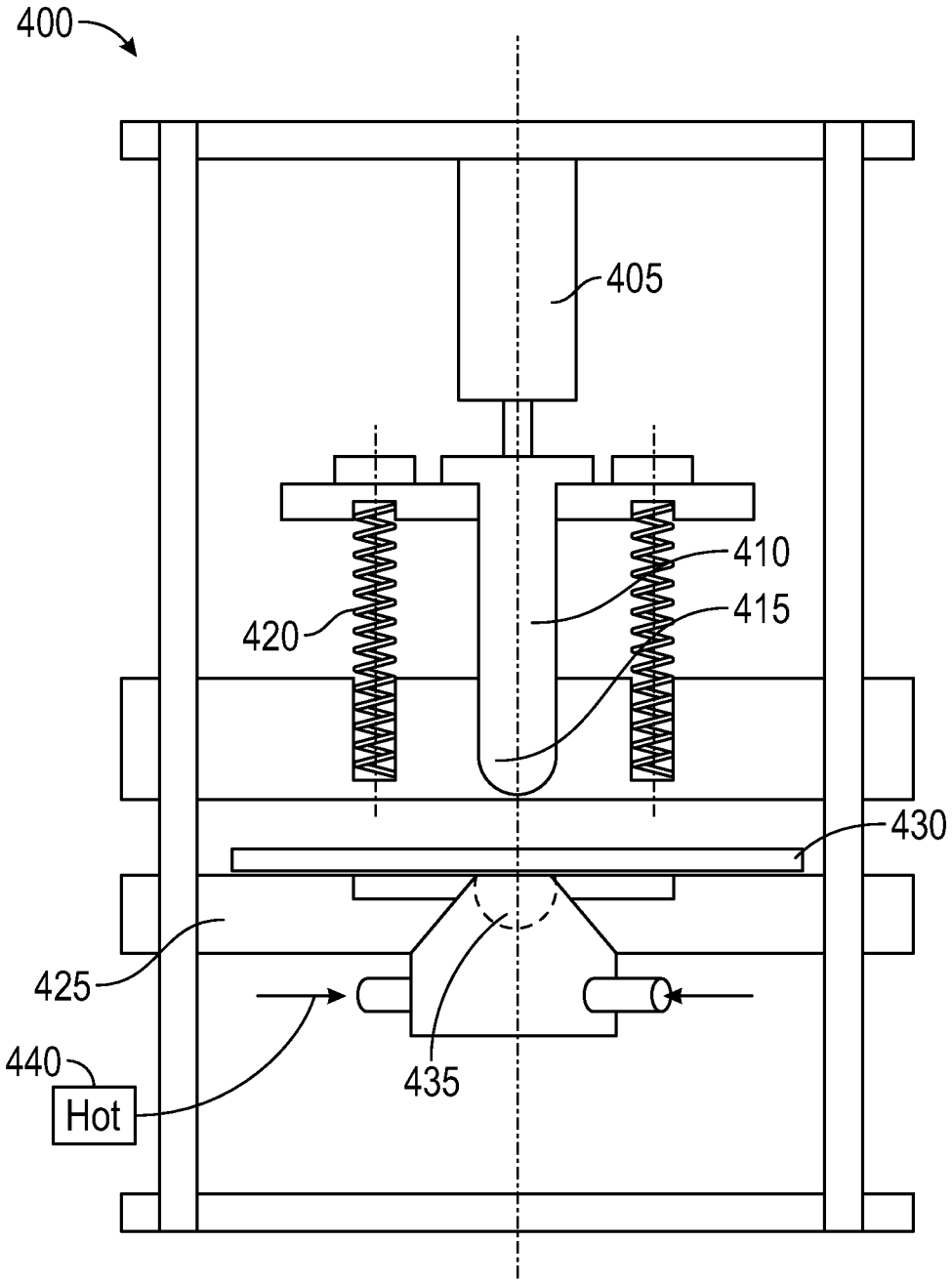
FIGS. 4A and 4B show an industrial tool which can be used to form the ball shaped area.
Figure 4B:
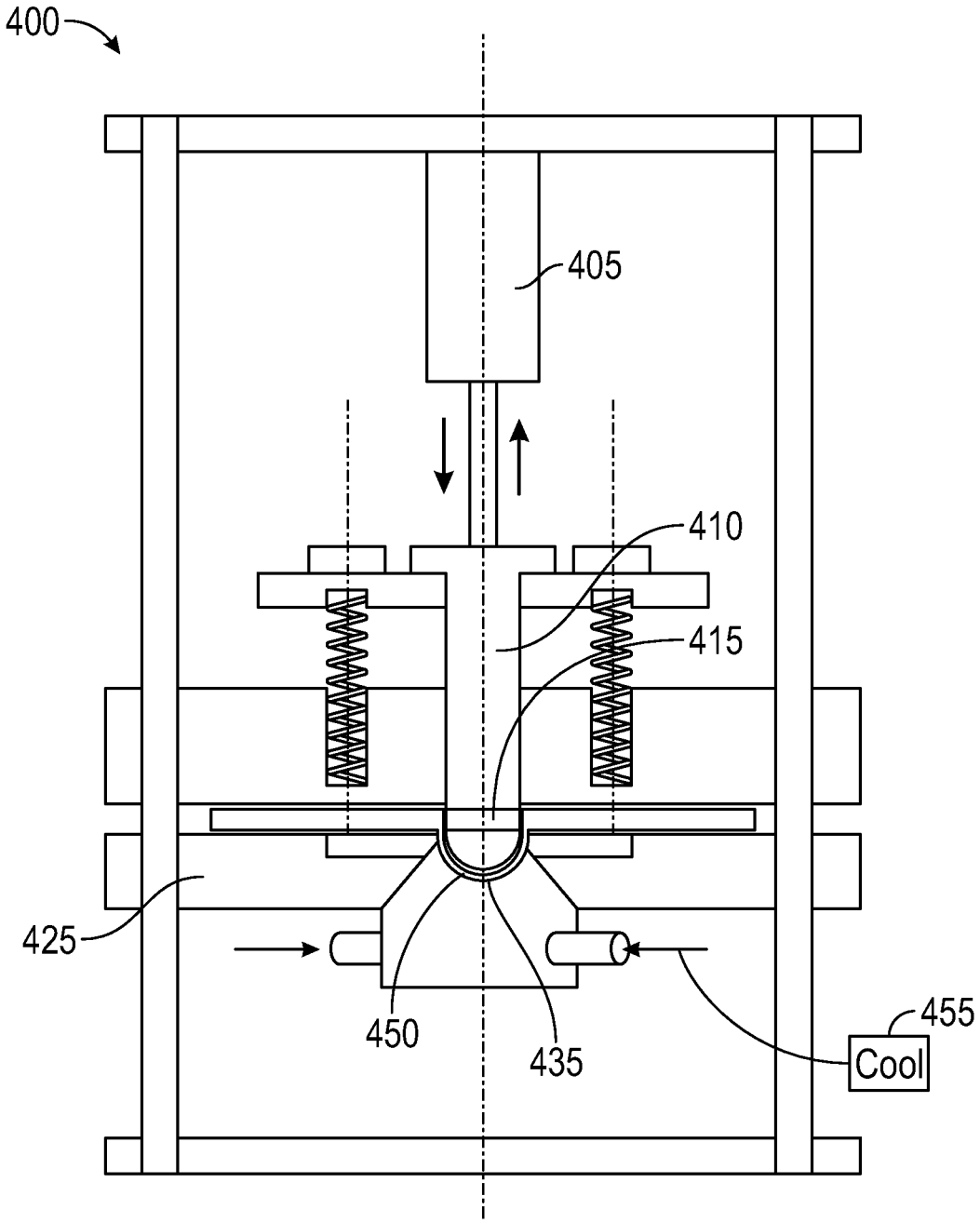

In one embodiment, an industrial tool 400 is used to form the ball shaped area 320, and subsequently to get the material tight around the ball. FIGS. 4A and 4B illustrate the tool, which uses a hydraulic Jack 405 to remove air and get the material tight around the ball. The hydraulic Jack 405 is used to press down on a punch 410. The punch has a convex cylindrical end 415, which will set the size of the inner surface of the pressure sensing fabric. The assembly also has 2 sets of springs 420, which are mounted to bias the punch 410 into the upward position shown in FIG. 4A. A working table 425 is formed with 4 layers of fabric 430 thereon. The 4 layers of fabric will be pressed between the convex end 415 of the punch, and a concave structure 435, which is formed in the working table 425. The inner surface of the concave structure 435 sets the size of the outer surface/ball shaped area 320 of the pressure sensing fabric. This may be, for example, the size of a regulation baseball minus the size of the baseball leather skin that will be used outside the pressure sensing fabric.

The concave structure 435 is also heated by hot pulsed air from a source 440. In operation, the hydraulic Jack is actuated to press down the punch 410 and press the convex portion 415 of the punch into the concave portion 435 of the punch, thereby deforming the fabric in the area 450 to form the ball shaped area 420. This is done while the fabric is being heated using the hot pulsed air. At this point, cool air from source 455 is added to cool the fabric and thus enable it staying into its rounded shape.

In an embodiment, the flex PCB can be one of the layers of fabric which is used.

In another embodiment, the flex PCB can be placed inside the inner surface of the ball shaped area 320 after its formation. The flex PCB board can be bent in any desired way, and is preferably bent into a rounded shape to attempt to equalize the weight from the different circuitry.

In one embodiment, a single chip can be used for all the different circuitry. However, it may be necessary to use separate for the rotatometer, accelerometer, gyroscope, wireless device, and battery. Each of these are spread in a way that maintains the radial weight symmetry of the ball.

In another embodiment, the operation may capture latent movement. The latent movement is measured from the time of release of the ball to the time of catching the ball. During that time between release and catching, velocity of the ball's movement is measured. The determination of when the baseball is caught is made by determining when the velocity number drops dramatically. Similarly, the time of release of the ball can be measured from the time the acceleration drops measurably. The system maintains a log from each specific throw, and takes a snapshot to find the latent movement.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art.

The device can be used for any kind of sports including a ball for baseball, bat for baseball, basketball soccer, cricket, volleyball, tennis, and golf. For example, when this is used for an element such as a bat, the computer may be set to sense a user doing practice hits, practice swings, or the like. Similar operations can be used for all different kinds of balls, baseball volleyball, golf ball, soccer ball.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

For example, this can be applied to other sports implements besides the ones described herein. Other kinds of sensors and detectors can be used.

What is claimed is:

1. A sports performance sensing device that communicates information to an external computer, comprising:

a housing, formed in a shape of a sports ball of a same weight and size as a regulation ball used in a game being played using the sports ball, the housing having an outer surface;

a finger pressure sensor, formed of a pressure sensing fabric inside the outer surface of the housing, the pressure sensing fabric sensing pressure over an entirety of the outer surface of the housing, to sense at least finger pressure and finger placement over an entirety of the outer surface of the housing, the outer surface formed of a skin of the sports ball, where the skin of the ball is shaven down so that a thickness of the skin of the sports ball is reduced compared to a normal thickness of a regulation ball to accommodate a thickness of the pressure sensing fabric;

additional sensors that are located inside the housing, which detect movements of the housing and transmit information indicative of said movements of the housing to the external computer, wherein the additional sensors include at least one of a speed sensor, a rotation sensor, and an acceleration sensor, and wherein the additional sensors are located in a way which is radially symmetrical, to maintain a radial symmetry of the sports ball; and circuitry inside the housing, receiving information from the finger pressure sensor, and transmitting the information to the external computer.

2. The device as in claim 1, wherein the circuitry inside the housing includes at least a battery, and a processor, and a wireless communication device, which receives information from the pressure sensing fabric, and creates a finger pressure map indicating where the user is touching the housing and a pressure of touching locations where the user is touching the housing, where the finger pressure map is transmitted to the external computer and is displayed on the external computer.

3. The device as in claim 2, wherein the additional sensors are radially symmetrical to maintain a radial symmetry of the ball.

4. The device as in claim 2, wherein the external receiving computer runs a program that compares information received from the device for a specific sports operation, with other information from the same specific sports operation at other times.

5. The device as in claim 3, wherein the sports ball is a baseball, and the computer runs a program that compares specific parameters for throwing a specific type of pitch with other parameters received at other times first allowing that specific type of pitch, and where the additional sensors are located to maintain the radial symmetry of the baseball.

6. The device as in claim 5, wherein the parameters are received are compared with other parameters from the same user throwing the same kind of pitch.

7. The device as in claim 5, wherein the parameters are compared with other parameters from a different user throwing the same kind of pitch.

8. The device as in claim 7, wherein the parameters includes speeds and vectors of using the ball.

9. The device as in claim 7, wherein the parameters include at least spin rate, speed, acceleration and deceleration, and timing and release of finger pressure on the ball.

10. The device as in claim 4, wherein the sports ball is a baseball, and the computer runs a program that compares specific parameters of throwing a specific distance with other parameters received at other times for allowing throwing that specific distance.

11. The device as in claim 10, wherein the parameters includes speeds and vectors of throwing the baseball.

12. The device as in claim 10, wherein the parameters include at least spin rate, speed, acceleration and deceleration, and timing and release of finger pressure for throwing that specific distance.

13. The device as in claim 2, wherein the battery is rechargable via a wireless charging, and includes a mark on an outer surface of the skin of the ball to mark a location of wireless charging.

14. The device as in claim 1, wherein the sports ball is hollowed in a center area, where the additional sensors form a nucleus in the center area of the sports ball, and further comprising a string assembly of wound strings wound around the sports ball to offset a weight difference of the center area of the sports ball which has been replaced by the nucleus.

15. A sports performance sensing device, comprising:

a housing, formed in a shape of a sports implement of a same weight and size as used in a game being played using the sports implement, the housing having an outer surface;

a finger pressure sensor, formed of a pressure sensing fabric inside the outer surface of the housing, sensing pressure the outer surface of the housing, to sense at least finger pressure and finger placement over the outer surface of the housing;

additional sensors that are located inside the housing, which detect movements of the housing and transmit information indicative of said movements of the housing to an external computer, wherein the additional sensors include at least one of a speed sensor, a rotation sensor, and an acceleration sensor, and wherein the additional sensors are located in a way which is radially symmetrical, to maintain a radial symmetry of the sports implement;

wireless transmitting circuitry inside the housing, receiving information from the finger pressure sensor, and transmitting the information to an external receiving computer;

wherein the circuitry inside the housing includes at least a battery, and a processor, and a wireless communication device, which receives information from the finger pressure sensor, and creates a finger pressure map indicating where the user is touching the housing and a pressure of touching locations where the user is touching the housing, where the finger pressure map is transmitted to the external computer and is displayed on the external computer, wherein the battery is rechargable via a wireless charging, and where the outer surface of the housing includes a visible mark on the outer surface of the sports implement to mark a location where the wireless charging is carried out.

* * * * *